United States Patent [19]

Albrecht et al.

[11] Patent Number: 4,567,993

[45] Date of Patent: Feb. 4, 1986

[54] TAMPER-EVIDENT CLOSURE

[75] Inventors: Leman P. Albrecht, Richmond; W. Cox Willis, Hagerstown, both of Ind.

[73] Assignee: Aluminum Company of America, Pa.

[21] Appl. No.: 628,651

[22] Filed: Jul. 6, 1984

[51] Int. Cl.[4] ..... B65D 49/12

[52] U.S. Cl. ..... 215/252; 215/258

[58] Field of Search ..... 215/252, 258

[56] References Cited

U.S. PATENT DOCUMENTS

| | | | |
|---|---|---|---|
| 3,329,295 | 7/1967 | Fields | 215/40 |
| 3,463,341 | 8/1969 | Fields | 215/42 |
| 3,944,102 | 3/1976 | Grau | 215/251 |
| 4,109,814 | 8/1978 | Rausing | 215/217 |
| 4,147,268 | 4/1979 | Patel et al. | 215/252 |
| 4,299,328 | 11/1981 | Ochs et al. | 215/252 |
| 4,322,012 | 3/1982 | Conti | 215/344 |
| 4,436,212 | 3/1984 | Llera | 215/252 |
| 4,461,390 | 7/1984 | Csaszar | 215/258 X |

*Primary Examiner*—Steven M. Pollard

*Attorney, Agent, or Firm*—Max L. Williamson

[57] ABSTRACT

A tamper-evident closure adapted for assembly with a container includes a band which, upon first opening, completely separates from a cap portion and which, upon reclosing the container with the cap, is dislodged from engagement with the container to insure that the band falls freely around a neck portion of the container to provide a substantial space between the cap and the band and thereby provide readily discernible evidence that the container has been previously opened.

21 Claims, 8 Drawing Figures

TAMPER-EVIDENT CLOSURE

BACKGROUND OF THE INVENTION

In the art of container closures, it is well known to provide tamper-evident closures which are intended to reveal upon inspection whether the container has been previously opened. Such tamper-evident packaging considerations have recently assumed increased importance and have become the subject of considerable attention owing to various instances of intentional tampering with such consumer products as pain relievers and other medications, and foodstuffs.

One type of tamper-evident closure system which is in widespread use includes a screw cap closure for the mouth of a container, such as a bottle or jar, which screw cap includes an annular band attached to the lower extremity of the screw cap skirt by frangible bridges or along a score line. The band typically is formed to cooperate with the jar or bottle during first opening thereof to break the frangible bridges or score line and thus separate the band from the cap skirt. The broken score line or fractured bridges are intended to provide indication after subsequent closing of the container that the container has been previously opened.

Although such prior closure systems have usually served their intended purposes, they have nevertheless not offered of certain improvements disclosed hereinbelow which in general offer vastly improved assurance of separation of the band from the cap and enhanced visual tamper indication. In particular, one shortcoming of some such prior closures has been that the frangible portion may not break uniformly; that is, substantially at the same time. If the closure has a plurality of identical bridges as the frangible connection between the cap and the band, the bridges would be expected to break in a substantially uniform manner. The frangible bridges, however, are typically small in cross-sectional area, and even minor variations in the mold can cause substantial differences in the cross-sectional area and the strength of one or more bridges as compared with the remainder of the bridges. Thus, it is not unusual that one or more bridges in a tamper-evident closure may be substantially stronger or weaker than the remainder of the bridges. It may be seen, therefore, that the weaker bridges may break preferentially, and in such a case, the remaining bridges may not break as they were intended to do. If the remaining bridges do not break from the predetermined cooperation between the band and the bottle, the band will not separate from the cap and will undesirably be removed with the cap.

Prior closures, such as Rausing U.S. Pat. No. 4,109,814 and Ostrowsky U.S. Pat. No. 4,206,851, for example, are adapted to intentionally provide at least one bridge or connecting portion between the cap and the band to ensure that the band remains attached to the cap upon removal of the cap from the container. Such closures are not suitable or preferred, however, for all applications by closure users.

Even if all of the frangible portions, such as bridges, break as intended, prior closures have had an additional shortcoming in providing evidence of tampering. As noted heretofore, fracture of the frangible portion is effected by a portion of the band cooperating with a container portion to arrest movement of the band. The cooperating features may be provided by adapting the band with projections which engage indentations in the container whereby the band is restrained from rotational and/or vertical movement. Another popular cooperating feature comprises an inwardly projecting lip or lug on the band adapted to abut a corresponding outwardly projecting ridge or ledge on the container which arrests vertical movement of the band to effect breakage of the frangible portion. Regardless of means employed to fracture the frangible portion, lodgement of the band with the cooperating feature of the container to effect fracture has been a problem. It may be seen that if the band becomes lodged with the container when the frangible portion fractures, the cap and band will be in substantially the same spatial relationship after the cap is reengaged with the container as was their relationship before the frangible portion fractured. When this happens, only a close visual inspection of the closure will provide evidence of tampering. It is desirable, therefore, that after the band is separated from the cap, that the space between the cap and band upon reengagement of the cap and container be sufficient to clearly provide evidence of tampering. Fields U.S. Pat. No. 3,329,295 suggests a solution to the problem by adapting the closure and container dimensionally so that the band will fall freely around the container neck after separation from the cap. Because of conflicting tolerances in making closures and containers, such a scheme is difficult to control. Furthermore, the band may cock and hang up on the container rather than fall freely as it is intended to do.

BRIEF SUMMARY OF THE INVENTION

The present invention concerns an improved tamper-evident closure wherein a cap is adapted to selectively close and open the mouth of a threaded container. An annular separable band is secured in coaxial juxtaposition to the lower extremity of the cap skirt by means of a plurality of circumferentially spaced apart frangible bridges or the like and is cooperable with an outwardly projecting ridge on the container to cause the frangible bridges to break and separate from the cap upon first opening of the container. The band is also cooperable with the container during the first opening to maintain the band in coaxial alignment with the cap prior to fracture of the bridges to ensure that all of the bridges will fracture and thus effect a complete separation of the band from the cap. The closure is also adapted to insure that upon subsequent replacement of the cap to close the container, the cap skirt forces dislodgement of the band from a lodged position around the container ridge which may result from maintaining control of the band during the first disengagement. After dislodgement, the band drops freely around a neck portion of the container of lesser diameter than the least inside diameter of the band to provide a distance of separation between the cap and band which is substantially greater than the distance of separation between the band and cap prior to fracture of the frangible means. Thus, the invention provides readily observable evidence of tampering.

As further evidence of tampering, the container with which the closure assembles may be provided with a visual tamper indicator, such as a contrasting color or design underlying the band. Such tamper indicator only becomes visible when the band is separated from the cap and is dislodged from the container ridge to fall freely around the container neck.

It is an object of this invention to provide a closure adapted to control a tamper-evident band during a first disengagement of a cap portion from a container by maintaining a coaxial relationship between the cap and the band prior to a complete fracture of a frangible means connecting the band and the cap and thereby better ensure a complete separation of the band from the cap.

It is also an object of this invention to provide an improved tamper-evident closure for a container wherein after first opening and then reclosing the container, a significant axial separation between the cap skirt and the separated band is insured.

It is an advantage of this invention that complete fracture of the frangible portion of a tamper-evident closure is better ensured even though the frangible portion is not uniform in cross-sectional area.

These and other objects and advantages of the invention will become clear upon consideration of the following description and the accompanying drawings.

BRIEF DESCRIPTION OF THE DRAWINGS

FIG. 1 is a cross-sectional elevation view of a preferred embodiment of a container closure of the present invention.

FIG. 2 is a cross-sectional elevation view of the closure shown in FIG. 1 engaged with a container.

FIG. 3 is a cross-sectional elevation view of the assembly shown in FIG. 2 with the cap partially removed from the container during a first removal and showing the separable band separated from the cap.

FIG. 4 is a cross-sectional elevation view of the assembly shown in FIG. 3 upon a first re-engagement of the cap with the container after the first removal of the cap. The cap is shown at the point of reengagement with the container whereby the cap causes the band to dislodge from the container ridge. The band is also shown in dashed lines in the position it assumes on the container after freely falling around the container neck.

DESCRIPTION OF A PREFERRED EMBODIMENT

In the following description of a preferred embodiment, such description is made with the closure and container as shown in the Figures; that is, with the central axes thereof vertical.

Figure 1:
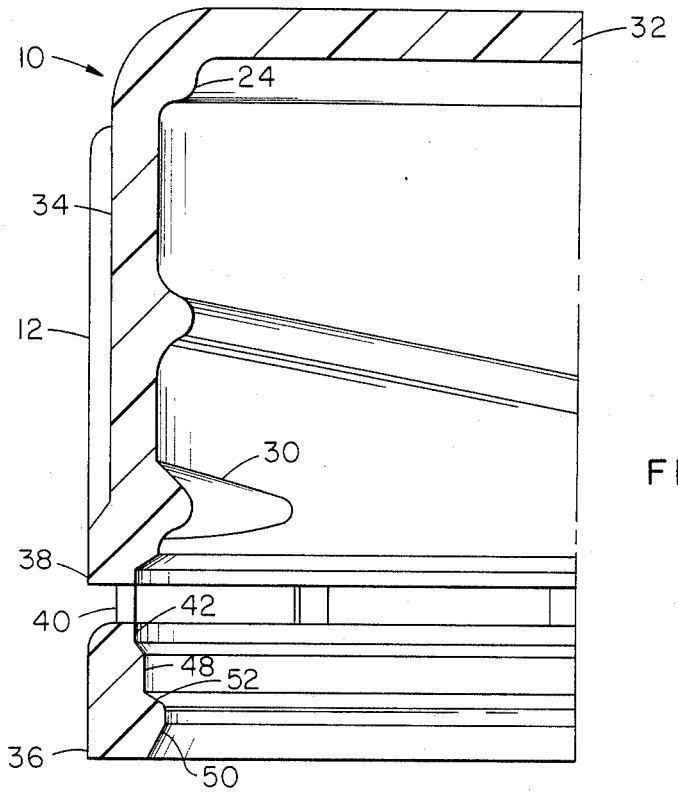
In FIGS. 1–4, only one half of the embodiments with reference to the indicated centerline or central axis are shown, it being understood that the embodiments are substantially symmetrical about the centerline.
Figure 2:
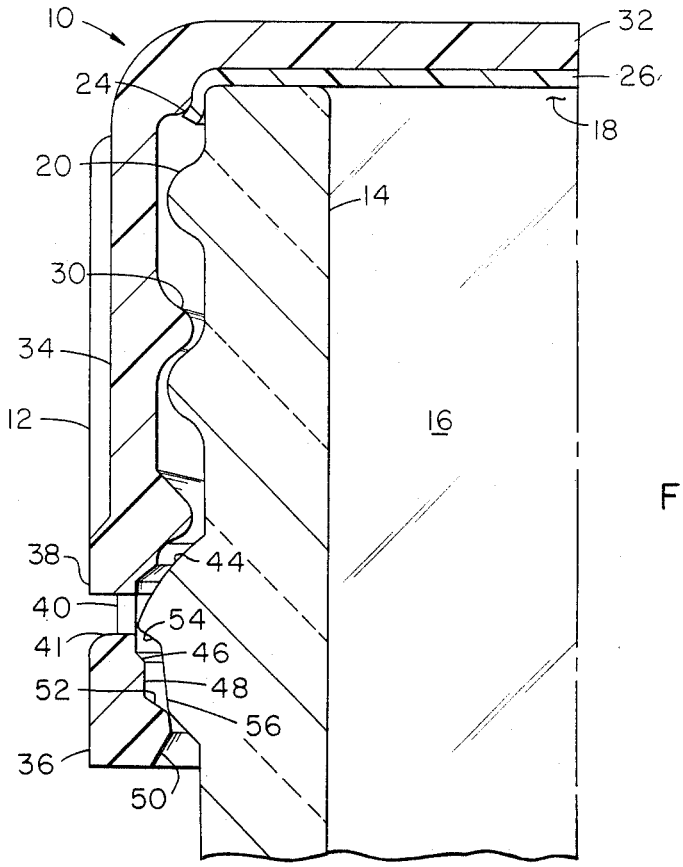

There is generally indicated at 10 in FIG. 1 a preferred embodiment of a closure of the present invention. Closure 10 includes a cap 12, preferably formed from molded plastic, which is cooperable with a generally cylindrical neck portion 14 of a container 16, such as a bottle, for example, as shown in FIG. 2, for selectively closing and opening the container 16.

As is well known, the neck portion 14 of container 16 includes a mouth portion 18 at the outermost axial extremity of neck portion 14, and external cap retention means, such as threads 20, by which cap 12 may be selectively secured to or removed from neck portion 14 to close or open container 16. Inasmuch as the above-described elements are well known to those versed in the relevant arts, further detailed description thereof is not believed necessary and is included herein only insofar as necessary for an understanding of the present invention.

Cap 12 includes an upper end wall 32 and a lower generally cylindrical skirt 34. Skirt 34 has formed internally thereof threads 30 which are cooperable with the above-described threads 20 for securing the cap 12 with respect to neck portion 14. End wall 32 closes one axial end of cap 12 and thereby serves to close mouth portion 18 of container 16 when cap 12 is in place thereon. An inwardly projecting shoulder 24 at the junction of end wall 32 and skirt 34 is provided to effect a side seal between the cap 12 and neck 14 when the closure is engaged with the container by thinning and thereby tightly compressing a peripheral portion of a plastic liner 26 disposed within the cap 12. It is understood that this invention is not limited to a particular mode of sealing, nor is it limited to use with a container requiring a seal.

A generally cylindrical separable band 36 in coaxial alignment with the cap 12 is attached adjacent a lowermost end portion 38 of skirt 34 by such suitable frangible means as a plurality of integral frangible bridge elements 40 of limited cross-sectional area which are spaced circumferentially about the adjacent cylindrical peripheries of skirt 34 and band 36. Other such suitable frangible means as a score line (not shown) may be employed in lieu of the bridge elements 40 to provide the requisite frangible function whereby band 36 may be separated from skirt 34. It may be seen that prior to fracture of the frangible means, the band is contiguous or at least closely adjacent the closure skirt.

Band 36 includes a first substantially cylindrical portion 42 extending downwardly from the top edge of the band, such portion having an inside diameter substantially equal to the outside diameter of the outwardly projecting ridge 44 of the container with which the closure assembles. A step 46 angles inwardly and downwardly from the first cylindrical portion 42 to a second substantially cylindrical portion 48, and an annular lug 50 projects into the closure therefrom. The upper surface 52 of the lug 50 is contoured to substantially conform to the underside 54 of the container ridge to interact with the container ridge when the cap 12 is removed from the container. Although the first step 46 and lug 50 are shown as continuously annular in this preferred embodiment, they could be circumferentially spaced apart steps and lugs for purposes of this invention.

As will now be explained, a closure of this invention provides means for controlling the band 36 during a first disengagement of the cap 12 from the container to maintain the band in coaxial alignment with the cap to better ensure that a complete separation of the band from the cap is effected. By a "first disengagement" is meant the first removal of the cap from the container after the closure, with the frangible portion connecting the cap and band intact, is initially engaged with the container. Referring to FIG. 2, the closure and container are shown in initial engagement as assembled by a suitable capping method. By such a method, the closure is screwed onto the container whereby the cap threads 30 engage the container thread 20 and band 36 snaps over container ridge 44. In the fully engaged position of the closure, the lug 50 is spaced axially away from the underside 54 of container ridge 44. Preferably, the surface of the ramp portion 56 angles downwardly and inwardly from the underside 54 of ridge 44 at an angle with vertical having a tangent substantially no greater than the coefficient of friction between the closure material and the container material for reasons that will be explained later. It is also preferable that the top edge 41 of the band lies in a plane that is substantially no higher on the container neck than a radial plane passing through the outermost extent of the ridge 44, but for reasons that will be explained, this is not essential.

To gain access to the container contents, cap 12 is rotated causing an upward axial movement of the cap and connected band 36. The first cylindrical portion 42 moves upwardly providing a substantially uniform circumferential sliding engagement with the ridge 44. Then, the angled step 46 contacts the container ridge 44 and provides a lead into the second cylindrical portion 48 which may be seen to have a somewhat smaller inside diameter than the outside diameter of the outermost extent of the ridge 44. The relatively tight fit between the second cylindrical portion 48 and the ridge 44 assists in maintaining the cap 12 and the band 36 in coaxial alignment as the cap is being disengaged by providing a uniform circumferential resistance against movement of the band along the line of tangency between the ridge and the second cylindrical portion of the band. It is important to control the band to maintain the cap and band in coaxial alignment during disengagement of the cap from the container because of undesirable results which may follow from misalignment or cocking of the band. Theoretically, as the cap and band are rotated during disengagement of the cap, they move axially upward as a unit and no misalignment would occur. Because of normal tolerances in making containers and closures, however, interaction between the container and closure will rarely, if ever, be precisely in accord with drawings having nominal dimensions. In making glass containers, for example, tolerances on the container finish are relatively broad; that is, the dimensions which control the exterior features of the container. It is possible, therefore, that during disengagement of the cap, some exterior feature of the container may tend to interfere with the uniform axial movement of the band and cause the band to cock unless control of the band is provided for. It may be seen that cocking of the band unbalances the load acting on the bridges imposing a greater load on one or more bridges than on the remainder, and the interference between the container finish and the cocked band may be sufficient to cause a premature fracture of one or more bridges.

Even if the closure and container were made to nominal dimensions and tolerance variations in the container and/or the closure did not create an interaction between the closure and container sufficient to cock the band, variations in the strength of the bridges can cause the band to cock. Since the bridges are designed to fracture and are relatively small in cross-sectional area, even minor variations in cross-sectional area from one bridge to another will affect the relative strength of the bridges. If one or more of the bridges are weaker than the remaining bridges, such weaker bridge or bridges may break preferentially whereby the load imposed upon the bridges is redistributed over the remaining unbroken bridges. Unless some provision is made to control the band, such a redistributed load may cause the band to cock which, as has been noted heretofore, may lead to even further preferential bridge breakage. Preferential breakage of bridges as just described, whether as a result of cocking the band or because of nonuniformity in the strength of the bridges, leads to the load on the bridges being redistributed through the remaining unbroken bridges and one of two undesirable results follows. If all of the remaining bridges fracture due to the increased load on the individual bridges resulting from the preferential fracture of one or more bridges, the cocked band will tend to remain lodged with the container ridge after all of the bridges are fractured. If one or more of the bridges do not fracture, the cocked band will tend to ride up over the container ridge and remain attached to the cap after the cap is removed.

In this preferred embodiment, as has been previously noted, the relative tight fit between the second cylindrical portion 48 and the ridge 44 assists in preventing the band from cocking and would be sufficient to prevent cocking if all of the bands were of substantially uniform strength. As further assurance against cocking of the band 36 out of coaxial alignment with the cap 12, the band is supported by the lug 50 which bears against container ramp 56. In this preferred embodiment, the closure is adapted so that lug 50 projects inwardly approximately adjacent the terminal end of container ramp 56. It may be seen that a slight rotation of the cap 12 brings the lug and ramp into sliding engagement, and as the band moves vertically upward during a first disengagement of the cap from the container, the lug 50 rides up the ramp 56. Thus, any unbalanced load circumferentially around the band due to preferential bridge breakage is prevented from cocking the band out of coaxial alignment with the cap by the lug 50 bearing against the container ramp 56. As has been noted heretofore, it is preferred that the ramp surface 56 angle downwardly and inwardly from the underside 54 of ridge 44 at an angle with vertical having a tangent substantially no greater than the coefficient of friction between the closure material and the container material. The reason for this preferred disposition of the ramp surface is to assist in preventing cocking of the band if preferential breakage of the bridge occurs. It may be seen that if one or more bridges break on one side of the closure, the total load on the bridges is redistributed through the remaining intact bridges. Since upward vertical movement of the band is a function of frictional resistance between the band and the ramp, it is desirable to minimize such resistance at least in the zone of the band where premature fracture of the bridges has occurred. Thus, if the ramp angle with vertical is such that frictional resistance between the band and ramp is not a factor, there will be less tendency for the band to cock as the band progresses vertically upward. As the rotational and axial movement of the band 36 continues, the upper surface 52 of lug 50 contacts the underside 54 of ridge 44. Interaction of the band with the ridge in the above manner arrests further axial movement of the band which causes all of the bridges or any remaining unbroken bridges 40 to fracture, as may be seen in FIG. 3. The cap 12 can then be removed from the container, and band 12 remains frictionally engaged with the ridge 44.

Figure 3:
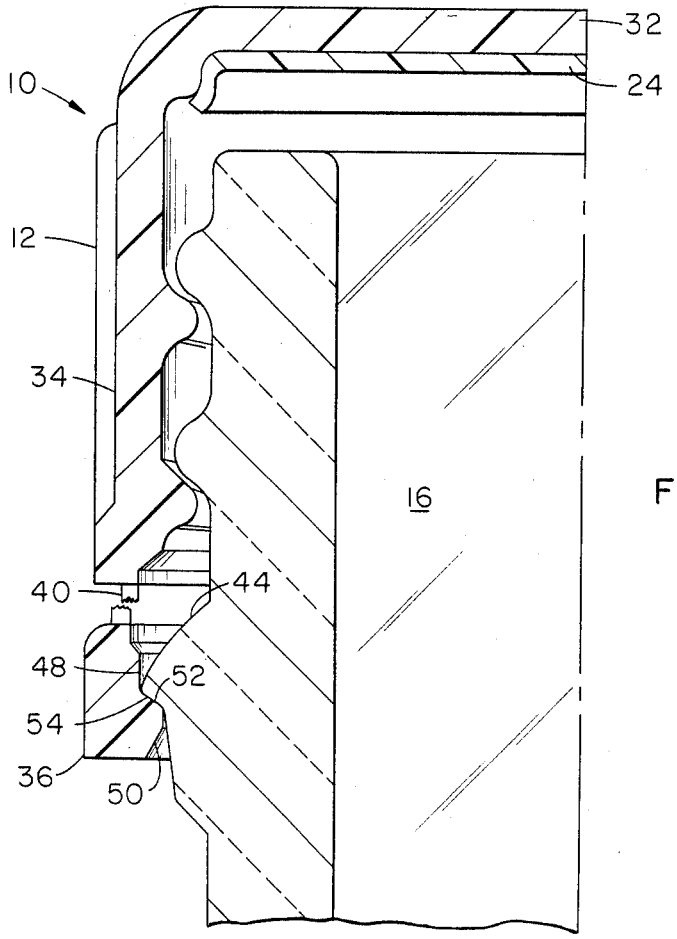
Figure 4:
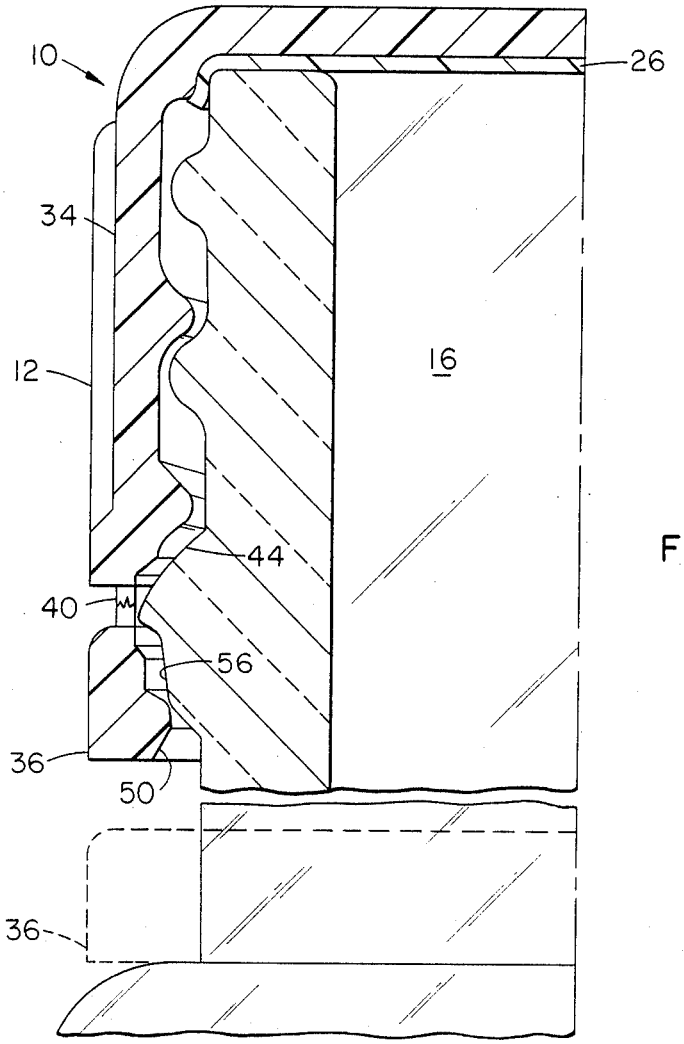

When cap 12 is reengaged in a first reengagement with the container and reaches the position shown in FIG. 3, it may be seen that further downward movement of the cap forces the band 36 downward as well. In FIG. 4, cap 12 is in its fully reengaged position with the container and has pushed the band 36 downward to the point of dislodgement from the ridge. The band 36 is then free to fall around the container neck to rest on an enlarged container portion, as shown by the dashed line in FIG. 4. Thus, when the band on a tamper-evident closure of this invention is first separated from the cap upon a first opening, the first reengagement of the cap with the container ensures that the band is separated from the cap a distance substantially greater than the distance of their separation prior to fracture of the bridges.

If desirable, additional evidence of tampering may be provided by including a distinguishing mark on the portion of the container neck underlying the band. For example, a circumferential ribbon of paint or tape in a color sharply contrasting to the color of the bottle might be applied, or the bottle might be molded with a clearly distinctive pattern circumscribing the neck. When the cap is initially removed from and reapplied to a container having such a marking, the distinctive marking on the bottle becomes exposed to view and provides further readily visible evidence of tampering.

Figure 5:
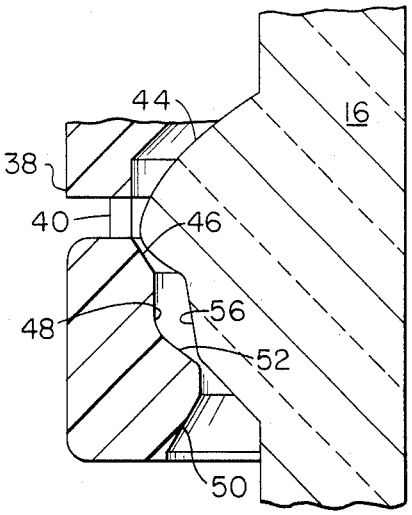
FIG. 5 is a cross-sectional elevation view of a fragmentary portion of an alternate embodiment of a closure of this invention in initial engagement with a container.

The preferred embodiment of this invention has been described with the band having an inwardly sloping step and an inwardly projecting lug, but the scope of the invention is not intended to be limited by such a band. For example, FIG. 5 shows a section of an alternate band configuration of a closure of this invention assembled in an initial engagement with the ridge portion of a container. In this alternate embodiment in FIG. 5, band 36 is connected to the bottom portion 38 of a cap skirt by frangible bridges 40. The band is substantially cylindrical with a lug 50 projecting inwardly for engaging an outwardly projecting ridge 44 on the container to effect breaking of the bridges 40 and separation of the band 36 from the cap when the cap is first disengaged from the container. In this embodiment, a ledge 46 angles inwardly and downwardly from the top of the band to a substantially cylindrical portion 48 which blends into the upper surface 52 of lug 50. The upper surface of the lug 52 is contoured to conform to the underside 54 of the ridge 44 for engagement therewith to break the bridges 40 and effect the separation of the band from the cap. As in the preferred embodiment, the lug 50 is adapted to contact a ramp portion 56 on the container with the ramp inclined at an angle having a tangent less than the coefficient of friction between the closure and container materials. In this embodiment, it may also be noted that the closure is adapted to position the top edge 41 of the band in a plane substantially no higher on the container neck than a radial plane passing through the outermost extremity of the ridge 44 when the closure is in initial engagement with the container. The foregoing description of opening a preferred embodiment and dislodging the band from the ridge 44 after the bridges are fractured is appropriate for the embodiment shown in FIG. 5 as well.

Figure 6:
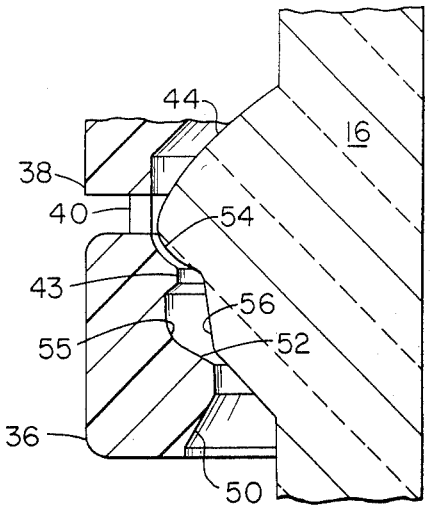
FIG. 6 is a cross-sectional elevation view of a second alternate embodiment of a closure of this invention in initial engagement with a container.

FIG. 6 shows yet another configuration for a band of a closure of this invention. In this embodiment, the band 36 is connected to the bottom skirt portion 38 of the cap by frangible bridges 40. A rib 43 projects inwardly from a portion of the band adjacent the top edge, and the top edge of the band lies in a plane substantially no higher on the container neck than a radial plane passing through the outermost extent of the container ridge 44 when the closure is in initial engagement with the container. A lug 50 projects inwardly from the band 36 and is adapted to contact a ramp 56 on the container which is inclined inwardly and downwardly from the underside of ledge 44 at an angle having a tangent less than the coefficient of friction between the closure and container materials. The upper surface 52 of the lug 50 is adapted to coact with the underside 54 of the container ridge 44 to effect fracture of the bridges 40 when the cap is removed from the container, and a substantially cylindrical portion 55 connects with the rib 43.

Figure 7:
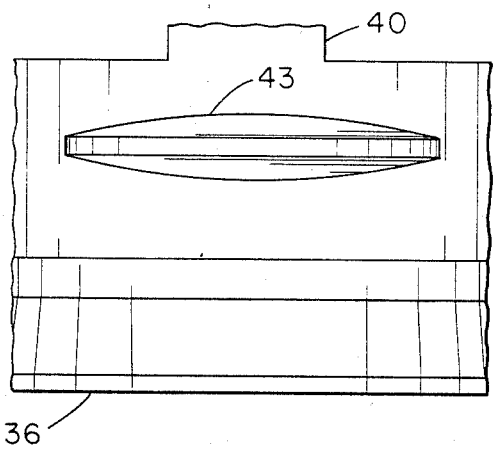
FIG. 7 is a fragmentary view of a portion of the closure embodiment shown in FIG. 6.

The rib 43 projects inwardly a substantially shorter distance than the lower lug 50 and may have an inclined upper surface similar to the upper surface 46 shown in FIG. 5 or the upper surface may be generally arcuate as shown in FIG. 6. In either case, the upper portion of the rib 43 is adapted to ride up and over the ridge 44 upon a first disengagement of the cap from the container. It may be seen that as the rib 43 moves upward, the band 36 is flexed outwardly until the rib clears ridge 44 and the band then snaps inwardly and the bottle ridge 44 is substantially confined between the rib 43 and lug 50 providing a positive safeguard against cocking the band. Rib 43 is shown in FIG. 6 as a continuous annular projection. For purposes of this invention, the rib need not be continuous, however. The rib 43 may be comprised of a plurality of circumferentially spaced apart rib portions, as shown in FIG. 7. The upper and lower surfaces of the rib portion 43 are shown as arcuate for ease of molding. In addition to ease of molding, providing the rib 43 as circumferentially spaced portions may also be advantageous in minimizing premature bridge breaking. Providing spaces between rib portions lowers the hoop strength of the band and thus makes it easier to flex the band in clearing the rib over the bottle ridge and lessens the possibility of premature bridge breakage.

When the cap is reengaged with the closure on a first reengagement, the band is dislodged from the ridge in a manner previously described.

Figure 8:
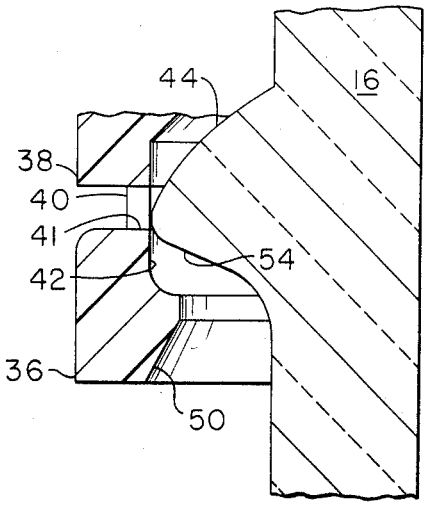
FIG. 8 is a cross-sectional elevation view of a third alternate embodiment of a closure of this invention in initial engagement with a container.

A less preferred embodiment of a band 36 of a closure of this invention is shown in FIG. 8. The band includes a substantially cylindrical portion 42 having an inside diameter no greater than the outside diameter of the ridge 44 to provide an interference fit. The cylindrical portion 42 extends downwardly from the top edge 41 of the band and fairs into the upper surface of inwardly projecting lug 50. The upper surface of lug 50 is adapted to coact with the underside 54 of ridge 44 to effect fracture of the bridges 40.

When the cap of a closure including the band embodiment shown in FIG. 8 is removed from a container in a first disengagement, the interference fit between the cylindrical portion 42 and the ridge 44 provides uniform circumferential resistance to movement of the band and controls the band to maintain the cap and band in coaxial alignment. It is noted in this band embodiment that lug 50 is adapted to be radially spaced away from the container and not bear against a ramp on the container during a first disengagement of the cap from the container. It may be seen that this band embodiment does not offer the degree of assurance against cocking of the band as does the previously described embodiments. This difference may be lessened, however, by adapting the length of the cylindrical portion 42 to the shortest possible within the commercial manufacturing tolerances of the container and closure. It may be seen that the shorter the length of the cylindrical portion 42, the lesser the vertical distance lug 50 travels before the upper surface engages the underside 54 of container ridge 44 to effect breakage of the bridges 40. The lesser the distance of vertical travel of lug 50 before engagement with ridge 44, the less is the possibility of cocking the band to override the ridge.

A feature of all of the previous embodiments of a closure of this invention is to adapt the closure to provide that the top of the band lies in a plane substantially no higher on the container neck than a radial plane passing through the outermost extent of the container ridge when the closure is in initial engagement with the container. It may be seen that it is theoretically essential that the band not be engaged with the ridge upon initial engagement of the closure with the container to insure that the band is dislodged from the container ridge by the cap when the cap is reengaged with the container upon a first reengagement. It should be noted, however, that the foregoing theoretical relationship of the band with respect to the container ridge in an initial engagement of the closure and container is not essential to a closure of this invention for the following reason. It is well known that plastics from which closures are made are yieldable and subject to deformation. For example, the bridges or other frangible portion of a tamper-evident closure will yield or elongate prior to fracture, and at least some portion of the elongation will remain after fracture of the frangible means as permanent set or deformation. It may be seen, therefore, that to the extent the frangible means is permanently elongated before fracture, the severed portions remaining on the cap and band will interfere when the cap is reengaged with the container and cause the band to dislodge from the ridge even if the band were slightly engaged with the ridge upon an initial engagement of the closure with the container.

In addition to the frangible means, the cap skirt and/or the plastic liner or other topside sealing feature may become at least partially permanently deformed upon initial engagement of the closure with the container. When the cap is reengaged with the container, it will not likely assume the precise position it was in prior to fracture of the frangible portion.

For the foregoing reasons, it is not essential for purposes of this invention that the band be completely free of engagement with the ridge upon an initial engagement of the closure with the container. Describing the relationship of the band with respect to the container upon an initial engagement of the closure with the container as adapting the closure so that the top edge of the band lies in a plane substantially no higher on the container neck than a radial plane passing through the outermost extent of the container ridge is intended to allow for permanent deformation of the plastic which may occur during an initial engagement and subsequent first disengagement.

According to the description hereinabove, there is provided by the instant invention a visual tamper indicator for a tamper-evident closure wherein the tamper indicator is displayed or revealed by creation of a significant gap between the skirt portion of a closure and an adjacent separable band portion of the closure during first opening and subsequent closing of the container to which the closure has been applied. The closure preferably is adapted to cooperate with the band retention portion of the container to ensure that the separable band will be dislodged from the retention portion upon closing of the container. The closure is further adapted to cooperate with the container to ensure that upon dislodging of the band from the retention portion of the container, the band will freefall away from the cap skirt to expose, display or reveal a visual tamper indicator.

It will be appreciated that various other embodiments and modifications would fall within the scope of this invention. These would include, but are not limited to, alternative structures for band retention by the cap and alternative modes of band separation. Of course, such other structural features as the profile and pitch of the mating threads, the nature of closure cooperation with the container opening and closing (i.e. other than threaded interengagement), the material from which the closure is formed, and the like, may be varied within a wide latitude of design practice.

These and other embodiments and modifications having been envisioned and anticipated by the inventors, it is intended that the invention herein be construed broadly and limited only by the scope of the claims appended hereto.

We claim:

1. A tamper-evident closure adapted for engagement with a container having an open-mouth cylindrical neck with closure engaging means thereon and an outwardly projecting annular ridge below the closure engaging means, the closure comprising:

a cylindrical cap having an end wall and a skirt depending therefrom with container engaging means thereon for engaging said cap with the container closure engaging means;

an annular band depending from and connected to the skirt by frangible means and having an inwardly projecting lug thereon which is spaced below the container ridge when the closure is fully engaged with the container so that the lug moves upwardly upon the first disengagement of said cap from the container until such movement is arrested by contact between said lug and the ridge to cause fracture of the frangible means and thereby separate said band from the skirt, and said band further includes an inwardly facing surface above said lug with said surface adapted to fit in interference with the container ridge sufficient to lodge said band on the ridge during the first disengagement and prevent said band from cocking during and through fracture of the frangible means to ensure complete separation of said band from the skirt and the skirt has an axial extent sufficient to contact the band and dislodge it from the ridge upon a first reengagement of the cap with the container to provide clear visual evidence of separation of said band from the skirt; and with the closure further adapted so that upon initial engagement of the closure with the container said inwardly facing surface above said lug is substantially no higher on the container than a plane passing through the outermost extent of the container ridge and no portion of said band is in contact with the container to an extent that said band would be prevented from falling freely downward around the container neck if the frangible means were fractured.

2. The closure as claimed in claim 1 wherein the frangible means is a plurality of circumferentially spaced bridges.

3. The closure as claimed in claim 1 wherein said lug has an inside diameter no greater than the outside diameter of a portion of the container neck immediately below the ridge.

4. The closure as claimed in claim 1 wherein said inwardly facing surface of said band is substantially cylindrical with an inside diameter no greater than the outside diameter of the outermost extent of the container ridge.

5. The closure as claimed in claim 1 wherein said inwardly facing surface comprises a recess above said lug with said recess adapted to be seated on the container ridge.

6. The closure as claimed in claim 5 wherein said inwardly facing surface includes an inwardly projecting rib above said recess with said rib being adapted to slide over the container ridge prior to seating of said recess on the ridge.

7. The closure as claimed in claim 5 wherein the maximum inside diameter of said recess is substantially no greater than the maximum outer diameter of the container ridge.

8. A tamper-evident closure adapted for engagement with a container having an open-mouth cylindrical neck, an outwardly projecting thread thereon, a ridge projecting outwardly from the neck below the thread, a ramp portion extending angularly downwardly and inwardly from the ridge and a substantially cylindrical neck portion extending downwardly from the ramp portion, the closure comprising:

a cylindrical cap having an end wall and a depending skirt, the skirt having an inwardly projecting thread thereon adapted to engage with the outwardly projecting container thread;

a separable annular band in coaxial alignment with and connected to the bottom edge of the skirt by frangible means, said band having an inwardly projecting annular lug thereon which is spaced axially away from and below the container ridge upon an initial engagement of said cap with the container, said lug having an upper surface adapted to contact at least a portion of the underside of the container ridge upon a first disengagement of said cap from the container to arrest upward travel of said band and thereby fracture said frangible means so that said band becomes separated from the skirt, and said lug also having an inside diameter such that said lug contacts at least a portion of the ramp during the first disengagement of said cap from the container, said band also having a portion above said lug adapted to fit in interference with the container ridge during the first disengagement of said cap from the container sufficient to lodge said band on the container ridge, the contacting of said lug against the ramp and the lodging of the portion above said lug on the ridge providing control of said band during the first disengagement of said cap from the container to prevent cocking of said band during and through fracture of the frangible means and ensure that said band is completely separated from said cap; and with the closure further adapted so that upon initial engagement of the closure with the container said inwardly facing surface above said lug is substantially no higher on the container than a plane passing through the outermost extent of the container ridge and no portion of said band is in contact with the container to an extent that said band would be prevented from falling freely downward around the container neck if the frangible means were fractured; and the skirt has an axial extent sufficient to contact the band and dislodge it from the ridge upon a first re-engagement of the cap with the container to provide clear visual evidence of separation of said band from the skirt.

9. The closure as claimed in claim 8 wherein the band portion above said lug includes a cylindrical portion having an inside diameter no greater than the greatest outside diameter of the container ridge.

10. The closure as claimed in claim 8 wherein the band portion above said lug includes a rib spaced away from said lug a distance sufficient that opposing surfaces on said rib and said lug contact and confine the container ridge therebetween and thereby lodge said band on the ridge when said cap is first disengaged from the container.

11. The closure as claimed in claim 10 wherein the rib comprises a plurality of circumferentially spaced rib portions.

12. The closure as claimed in claim 8 wherein the closure is adapted for disposition of the lug below the container ramp upon the initial engagement of the closure with the container.

13. A tamper-evident closure in a fully engaged combination with an open-mouth container, the combination comprising:

a container having an open-mouth cylindrical neck, means for engaging a closure therewith below the open mouth, and an outwardly projecting ridge below the closure engaging means; and a closure comprising a cap having an end wall, a skirt depending therefrom with engaging means thereon engaged with the engaging means on the container, and a band connected to the skirt by frangible means, said band having an inwardly projecting annular lug disposed below and spaced away from the container ridge with the lug having an upper surface adapted to contact the underside of the container ridge to arrest upward movement of said band upon a first disengagement of said cap from the container and effect fracture of the frangible means so that said band separates from the skirt, and said band further having a portion above said lug adapted to be sufficiently free from contact with the ridge to fall freely therefrom if the frangible means were fractured and to fit in interference with the container ridge as said band moves axially upward during the first disengagement of the cap from the container sufficient to lodge said band on the ridge and prevent cocking of said band during and through fracture of the frangible means to ensure complete fracture of the frangible means and separation of said band from the skirt; and with the skirt having sufficient axial extent to contact said band and dislodge it from the ridge upon a first re-engagement of the cap with the container whereupon said band is free to fall downward around the container neck and provide clear visual evidence of separation of said band from the skirt.

14. The combination as claimed in claim 13 wherein the top edge of the band portion adapted to fit in interference with the container ridge is no higher on the container neck than the bottom edge of a portion of the container ridge having the greatest diameter.

15. The combination as claimed in claim 13 wherein said band portion adapted to fit in interference with the container ridge is a cylindrical portion having an inside diameter no greater than the greatest outside diameter of the container ridge.

16. The combination as claimed in claim 13 wherein said band portion adapted to fit in interference with the container ridge is a rib spaced apart from said lug a distance sufficient that opposing rib and lug surfaces contact the container ridge and confine it therebetween and thereby lodge said band on the ridge when said cap is first disengaged from the container.

17. The combination as claimed in claim 16 wherein said rib is comprised of a plurality of circumferentially spaced apart portions.

18. The combination as claimed in claim 13 wherein the container includes a ramp portion extending downwardly and inwardly from the container ridge to the container neck.

19. The combination as claimed in claim 18 wherein said lug is disposed below the ramp.

20. The combination as claimed in claim 18 wherein the ramp has an angle with respect to vertical substantially no greater than an angle having a tangent equal to the coefficient of friction between the closure and container materials.

21. A tamper-evident closure for engagement with an open-mouth container having closure engaging means below the mouth and an outwardly projecting ridge below the closure engaging means, the closure comprising:

a cylindrical cap having an end wall, a skirt depending therefrom, means on the skirt for selective engagement and disengagement with the closure engaging means;

an annular band connected to the skirt by frangible means with the band having an inwardly projecting lug thereon;

the closure adapted to position the band upon a first engagement of the closure with the container so that no portion of the band is in contact with the container sufficient to prevent the band from falling freely downward around the container neck if the frangible means were fractured and the lug is spaced axially below the container ridge whereby the lug moves axially upward upon an initial disengagement of the cap from the container until the lug makes contact with the ridge sufficient to arrest its upper movement and thereby cause complete fracture of the frangible means to separate the band from the cap;

means for controlling the band to maintain the band in coaxial alignment with the cap during the first disengagement of the cap to prevent the band from cocking prior to separation of the cap from the band and for engaging the band with the ridge so that the band is lodged thereon after separation from the cap; and with the closure adapted so that said engaging and controlling means is substantially no higher on the container than a plane passing through the outermost extent of the container ridge upon initial engagement of the closure on the container and said skirt has an axial extent sufficient to contact the band and dislodge it from the ridge upon a first re-engagement of the cap with the container.

* * * * *